United States Patent [19]

Travor et al.

[11] Patent Number: 5,042,744

[45] Date of Patent: Aug. 27, 1991

[54] GUIDEABLE STORES

[75] Inventors: Bruce W. Travor, Holland; James F. McEachern, Newtown; Frank P. Marshall, Penns Park, all of Pa.

[73] Assignee: The United States of America as represented by the Secretary of the Navy, Washington, D.C.

[21] Appl. No.: 579,922

[22] Filed: Aug. 30, 1990

[51] Int. Cl.[5] ..... F42B 10/16; F42B 10/36

[52] U.S. Cl. ..... 244/3.29; 102/382; 244/3.27

[58] Field of Search ..... 244/34, 34 A, 35, 38, 244/45 R, 3.27, 3.29; 102/384, 385, 388, 382

[56] References Cited

U.S. PATENT DOCUMENTS

| | | | |
|---|---|---|---|
| H, 685 | 10/1989 | Olson et al. | 244/3.29 |
| 1,448,166 | 3/1923 | Strong | 244/3.29 |
| 3,135,484 | 6/1964 | Herrmann | 244/34 A |
| 3,154,269 | 10/1964 | Musil | 244/34 A |
| 3,188,957 | 6/1965 | Petre | 244/3.27 |
| 3,374,969 | 3/1968 | Rhodes | 244/3.27 |
| 3,710,715 | 1/1973 | Hoofnogle | 244/3.27 |
| 3,903,639 | 9/1975 | Howell | 244/34 A |
| 4,752,052 | 6/1988 | Galvin | 244/3.29 |
| 4,796,835 | 1/1989 | Galvin | 244/3.29 |
| 4,829,903 | 5/1989 | Axinger et al. | 244/3.27 |

*Primary Examiner*—David H. Brown

*Attorney, Agent, or Firm*—James V. Tura; James B. Bechtel; Susan E. Verona

[57] ABSTRACT

A guideable sonobuoy is disclosed that is ejected from a moving aircraft into the free stream with a ring wing opened to guide the buoy along a predetermined flight path. While the buoy remains packed inside a launch container, the ring wing, made of spring steel, is collapsed around the nose portion thereof. Once launched, the ring wing will fly the buoy to a predetermined destination.

7 Claims, 4 Drawing Sheets

FIG. 2
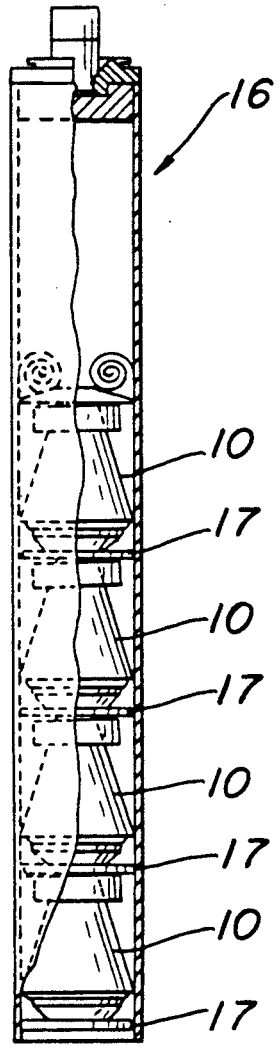
FIG. 4
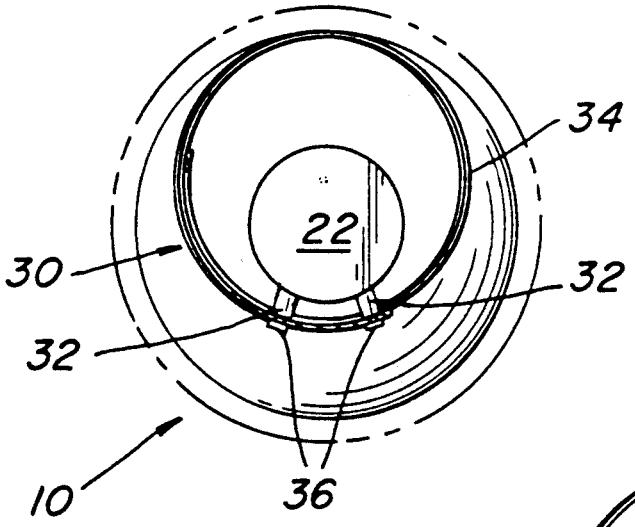
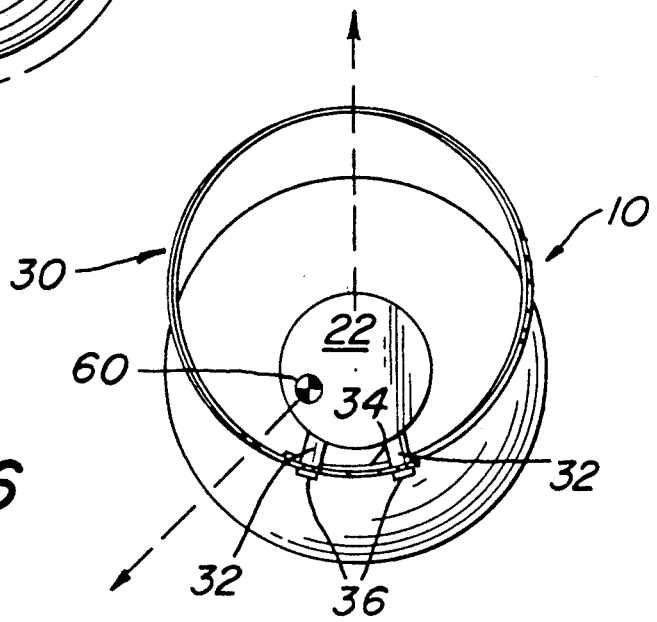
FIG. 6

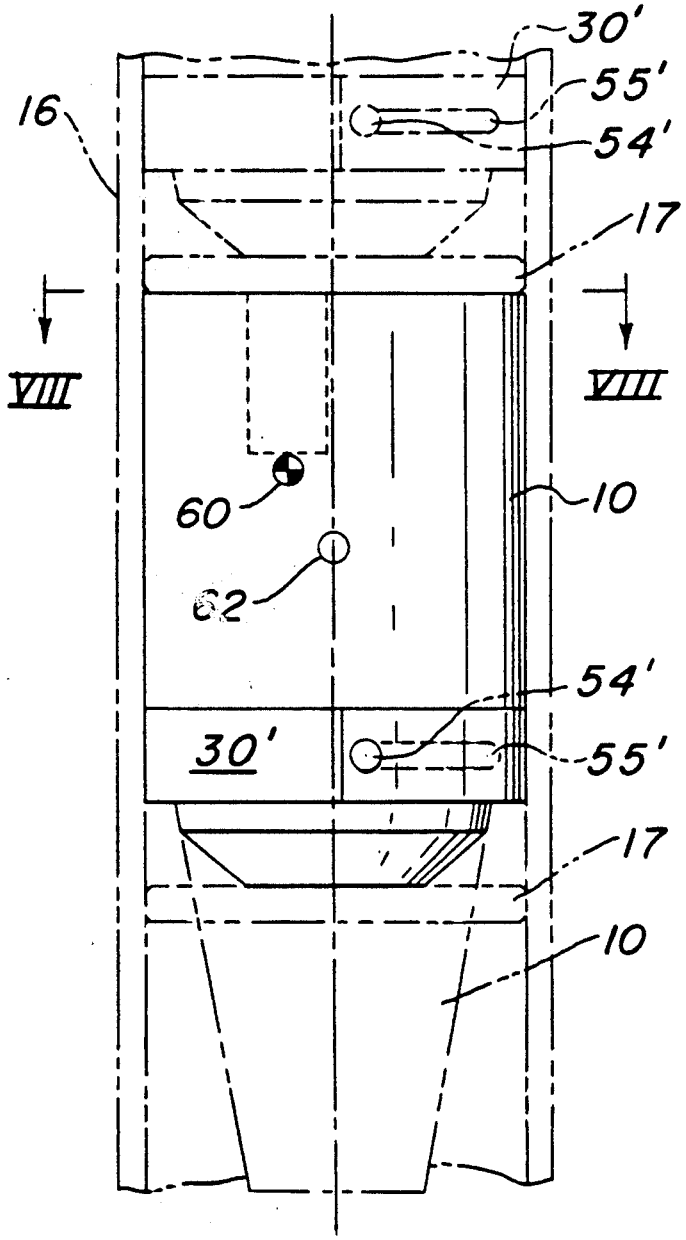
FIG. 7
FIG. 8
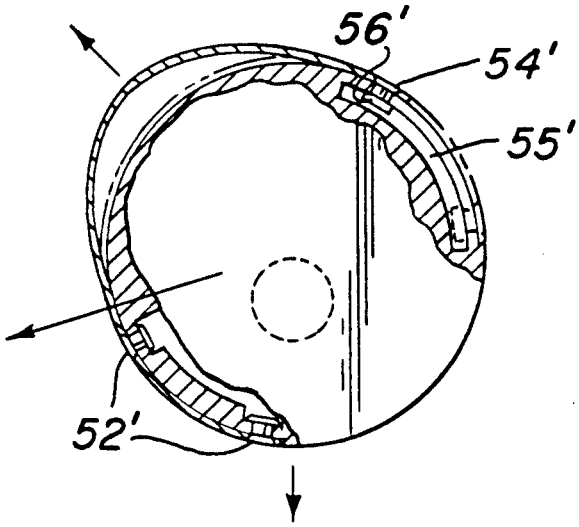

GUIDEABLE STORES

STATEMENT OF GOVERNMENT INTEREST

The invention described herein may be manufactured and used by or for the Government of the United States of America for governmental purposes without the payment of any royalties thereon or therefore.

FIELD OF THE INVENTION

This invention relates to objects that can be air-dropped from aircraft. In particular, this invention relates to guideable stores that are air-dropped from an aircraft and will glide to a predetermined location on the earth's surface.

BACKGROUND OF THE INVENTION

It is many times extremely valuable to release a multitude of objects, such as stores or sonobuoys, from an aircraft flying at a predetermined speed to cover a wide dispersal, geographical area. This problem is made more difficult by attempting to maintain all of the objects internal to the transporting aircraft. The low exit velocities of the objects cause them to merely fall beneath the aircraft in a relatively straight line. If parachutes are attached, they, too, will cause drift in nearly the same direction.

A flight control means for bombs is disclosed in U.S. Pat. No. 1,324,433, entitled "Flight-Control Means For Bombs", issued on Dec. 9, 1919 to G. T. Phillips, Jr. This patent discloses means which continue to direct the flight path of the bombs, once released from an aircraft, mainly in the vertical direction. Another invention, described in U.S. Pat. No. 2,584,826 entitled "Aerodynamic Surface For Dirigible Bombs", issued on Feb. 5, 1952 to R. D. Wyckoff, also shows that bombs may have lifting surfaces in the form of a prismatic shell. Neither of these two devices disclose how a store may achieve a predictable flight path, without using moveable control surfaces, once released from an aircraft.

SUMMARY OF THE INVENTION

It is therefore an object of the present invention to provide a guideable store that, when air-dropped from an aircraft, falls in a predictable flight-path to a prescribed destination.

It is a still further object of the present invention to provide such a guideable store that does not use expensive components and is easy to assemble.

It is a still further object of the present invention to provide such a guideable store that is lightweight and relatively small so that a plurality thereof can be dispensed during one pass yet provide widespread coverage over a selected territory.

These and other objects of the invention are attained by providing a collapsible and expandable flexible ring wing for use on an individual store, such as a sonobuoy, to achieve a wide dispersion pattern of a plurality of such stores. The ring wing can be made from a solid, yet flexible material such as spring steel, into a thind band appropriately sized to the circumference of the store it will be attached to and to the amount of lift it will be expected to generate. The wing can be flexibly held, in either a collapsed configuration (for storage or transport) or its expanded configuration (for deployment) by at least two positioning devices. The devices may be either fixedly attached to the store or to end sections of the wing and act to both maintain the wing in its proper place adjacent the store and to releaseably controlled expansion of the wing at the proper time.

BRIEF DESCRIPTION OF THE DRAWINGS

FIG. 2 shows an elevation view of a sonobuoy launch container (SLC) suitable for dispensing guideable sonobuoys after a plurality of said sonobuoys have been dispensed;

FIG. 4 shows a front view of a guideable sonobuoy taken along lines IV—IV of FIG. 3;

FIG. 6 shows a front view of the guideable sonobuoy taken along lines VI—VI of FIG. 5;

FIG. 7 shows a view, similar to that of FIG. 3, of an alternate embodiment of a guideable sonobuoy; and FIG. 8 shows a cross-sectional view of the alternate embodiment as taken along lines VIII—VIII of FIG. 7.

DETAILED DESCRIPTION OF THE PREFERRED EMBODIMENT

Figure 1:
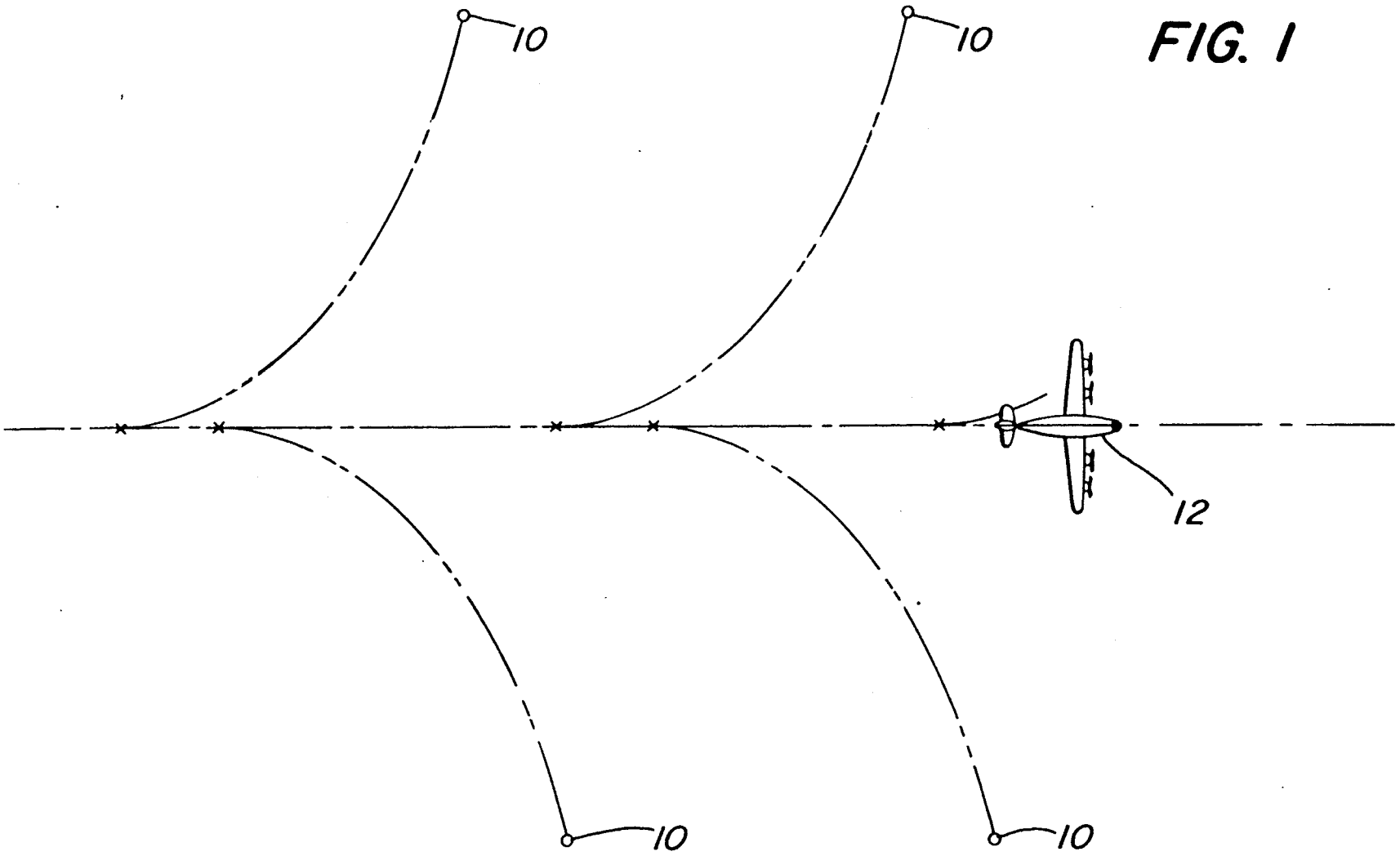
FIG. 1 shows a schematic representation of an aircraft dispensing guideable sonobuoys.

Referring now to the drawings wherein the reference numerals designated like parts throughout the several views, effectively and predictably obtain a lateral dispersion pattern, as shown schematically in FIG. 1 of guideable stores, flares, sonobuoys or other similar types of objects 10 launched from a single launcher carried by a single vehicle, such as an aircraft 12. FIG. 2 shows a longitudinal view, with portions cutaway, of such a launcher 16, which is similar to the one more fully described in pending U.S. patent application Ser. No. 07/544,295, assigned to the United States of America as represented by the Secretary of the Navy.

Figure 3:
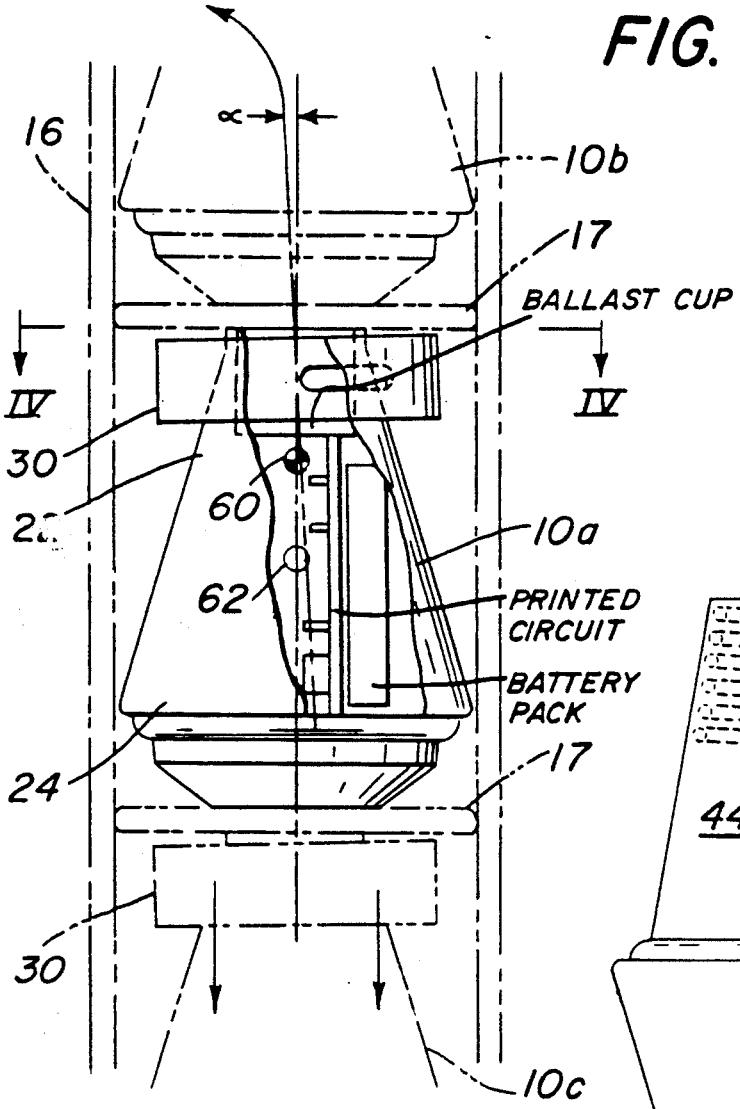
FIG. 3 shows a fragmentary and enlarged view of a plurality of guideable sonobuoys (one shown in phantom) inside a launch container (also shown in phantom)
Figure 5:
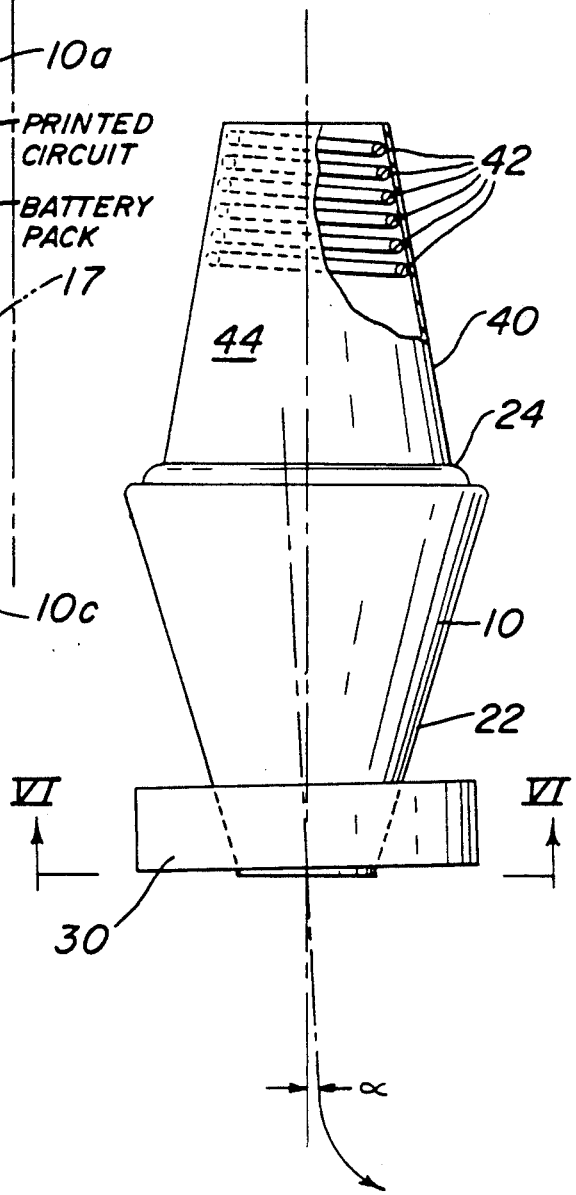
FIG. 5 shows an elevational view of a guideable sonobuoy after being ejected from the launch container.

The guideable stores 10 of the present invention can be more easily understood by looking at FIGS. 3, 4, 5 and 6. FIG. 3 shows a fragmentary and enlarged elevational view of a plurality of stores 10*a, b, c* (store 10*b, c* shown in phantom) inside launcher 16 (also show in phantom) and FIG. 4 shows a front view of store 10 taken along lines IV—IV of FIG. 3. Stores 10 are made in the shape of a truncated cone, having a front end 22 and a back end 24. Stores 10 can have an outer shell body made of any strong, durable and lightweight material such as ABS plastic, and are loaded into launcher 16 sandwiched between disc-shaped sabots 17. Sabots 17 maintain each store 10 in its relative and proper position inside launcher 16 and prevent movement therein while the launcher is being transported. FIGS. 5 and 6 show, respectively, an elevational view and a front view of store 10 after it has been ejected into the free airstream.

Store 10 carries an expandable ring wing 30 slidably fixed to a pair of projections 32 from the side surface of front end 22. Wing 30 is made from a strong, flexible and lightweight spring steel band and can be from one-sixteenth inch thick as necessary and from 1.0 inches wide, as applicable, depending on the total weight of store 10. Projections 32 can be either set at matching and oppositely-disposed positions or staggered longitudinally (not shown) on the side of front end 22 and wing 30 has slots 34 cut therein that are sized just large enough in width to slidingly pass by the reduced diameter of projections 32 but yet be captured by end pieces 36 secured thereon. Projections 32 therefore act as positioning means for wing 30. As can be seen in FIGS. 4 and 6, wing 30 is flexible enough to be folded, or rolled, inside of itself as store 10 rides in launcher 16 (seen in phantom in FIG. 4). Wing 30, by the natural tendency of the spring steel material to attempt to unwind, automatically expands and opens up, as shown in FIG. 6, once store 10 is ejected.

A tail cone 40, made from a helical expansion spring 42 and shrouded by strong yet lightweight cloth 44, is fixed to the back end 24. As each store 10 is loaded inside launcher 16, spring 42 collapses inside of itself and is reduced in size, as shown in FIG. 3. The natural tendency of the expansion spring to open up as soon as store 10 clears away from sabot 17 allows tail cone 40 to form, as seen in FIG. 5.

FIGS. 7 and 8 show an alternate construction of store 10' and show that the body can be in the shape of a right circular cylinder. In this case, wing 30' is flexibly attached to back end 24' by attaching a first end, as at 52' and by sliding the opposite end and its stud 54' along slot 55'. As with the preferred embodiment, end cap 56' is larger than slot 55' and remains captured thereby.

OPERATION

Stores 10 are stacked inside launcher 10 to be ejected back end first to place wing 30 facing into the airstream. Cone 40 and wing 30 both expand to their limits. Each store 10 is designed to utilize the effects of gravity as well as the aerodynamic forces, caused by the horizontal movement, acting on store 10. The orientation of wing 30, once it springs open, in relation to the heaviest part of the body allows gravity to force store 10 to roll about its longitudinal axis so that the heaviest part of the store is facing down toward the earth and the wing is at the uppermost position. In addition, store 10 is designed so that the center of gravity, graphically shown on store 10 by 60, is always in front of, or closer to wing 30 than, the center of pressure, shown as 62. This ensures that store 10 can achieve aerodynamic stability.

The desired dispersion, towards either the left or the right of the flighpath, is achieved by positioning wing 30 at a pre-determined angular variation from a plane completely perpendicular to the front end 22, shown by the symbol alpha (in FIG. 3). Because of this offset, and the lift force generated by wing 30, a resultant force is developed, which force turns store 10 in flight. Of course, to obtain the diverse dispersion, as seen in FIG. 1, alternate stores 10 would have their wings 30 set with opposite variations.

Finally, while the guideable store has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

What we claim is:

1. A guideable store, that is launched from a launch container at a prespecified velocity and altitude and will land at a predetermined destination, comprising:

a store body with a front and a back end; and ring means slidably attached to an end of said body to provide guiding lift to the store.

2. A guideable store as described in claim 1 wherein said ring means is a thin band of prespecified width.

3. A guideable store as described in claim 2 wherein said ring means is slidably attached to the front end by positioning means that controls the collapse of said ring means as the store is contained in the container and controls the expansion thereof as the store is ejected from the container.

4. A guideable store as described in claim 2 wherein said ring means is slidably attached to the back end by positioning means that controls the collapse of said ring means as the store is contained in the container and controls the expansion thereof as the store is ejected from the container.

5. A guideable store as described in claim 3 wherein said positioning means includes a pair of projections extending from the front end and into and through a slot cut in said ring means and having means thereon to allow controlled and slideable movement by said ring means.

6. A guideable store as described in claim 4 wherein said positioning means includes affixing one end of said ring means to the store body and attaching slidable button means to the opposite end and positioning said button means inside a slot in the store body.

7. A guideable store that is launched from a launch container at a prespecified velocity and altitude and will land at a predetermined destination, comprising:

a. a store body, with a front and a back end, for carrying internal components arranged such that the resultant center of gravity is closer to the front end than the resultant center of pressure;

b. a plurality of projections affixed to the front end of said store body; and c. a thin, flexible band encircling the store body and slideably affixed to said projections, said band remaining in a compressed position relative to the body until release from the launch container whereupon said band expands to predetermined limits.

* * * * *